US008127384B2

(12) United States Patent
Carlton

(10) Patent No.: US 8,127,384 B2
(45) Date of Patent: Mar. 6, 2012

(54) INFANT LULLING DEVICE

(76) Inventor: Christine Frances Carlton, Evans, GA (US)

( * ) Notice: Subject to any disclaimer, the term of this patent is extended or adjusted under 35 U.S.C. 154(b) by 0 days.

(21) Appl. No.: 11/545,854

(22) Filed: Oct. 3, 2006

(65) Prior Publication Data

US 2007/0074348 A1 Apr. 5, 2007

Related U.S. Application Data

(60) Provisional application No. 60/596,553, filed on Oct. 3, 2005.

(51) Int. Cl.
*A47D 13/00* (2006.01)

(52) U.S. Cl. ..... 5/655; 5/904; 5/639

(58) Field of Classification Search ..... 5/636, 639, 5/655, 904, 907, 915, 640; 600/25–28
See application file for complete search history.

(56) References Cited

U.S. PATENT DOCUMENTS 3,292,611 A 12/1966 Belkin
3,419,923 A 1/1969 Cowan
3,946,316 A * 3/1976 Hough ..... 455/344
3,994,282 A 11/1976 Moulet
4,091,481 A * 5/1978 Redman ..... 5/639
4,124,022 A 11/1978 Gross
4,941,453 A 7/1990 Shakas et al.
D311,472 S * 10/1990 Giles ..... D6/601
4,968,279 A * 11/1990 Smith ..... 446/71
4,969,867 A * 11/1990 Cohen ..... 600/28
5,014,376 A 5/1991 Doran et al.
5,063,912 A 11/1991 Hughes
5,205,811 A * 4/1993 Fornarelli ..... 600/28
5,357,642 A 10/1994 Clute
5,813,065 A * 9/1998 Tinhorn ..... 5/639
6,006,381 A * 12/1999 Tandrup ..... 5/655
6,170,602 B1 * 1/2001 Mann ..... 181/141
6,493,888 B1 12/2002 Salvatini et al.

* cited by examiner

*Primary Examiner* — Michael Trettel

(57) ABSTRACT

A device for lulling infants to sleep comprising a pillow with a receptacle and closure, wherein the middle portion of the sides of the pillow are curved inwards to form four corner sections, and wherein the corner sections of the pillow are puffed up compared to the rest of the pillow, so that the pillow can be easily used in conjunction with cradles, bassinets, strollers, and similar baby gear;. The device further comprises a battery-operated sound/vibration generating instrument received within the receptacle. The instrument can be operated to produce either sound or vibrations, or both. The sound comprises a simulated mother's heartbeat or a lullaby.

2 Claims, 5 Drawing Sheets

INFANT LULLING DEVICE

CROSS-REFERENCE TO RELATED APPLICATION

This application claims the benefit of U.S. Provisional Application No. 60/596,553, filed Oct. 3, 2005.

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

FEDERALLY SPONSORED RESEARCH

Not Applicable

SEQUENCE LISTING OR PROGRAM

Not Applicable

BACKGROUND

The present invention relates in general to neonatal accessories and more particularly to an infant lulling device for providing a comforting and a soothing environment by which an infant can be easily lulled to sleep.

Babies, particularly during infancy, require frequent care and attention, including rest as often as possible to promote good health. It has been observed that infants are easily distracted by noises or erratic sounds, which make promoting adequate sleep difficult. Devices are known in the art to help lull infants to sleep. Typically, these devices promote an atmosphere of well being for infants, helping them fall asleep faster and remain asleep for longer periods of time.

U.S. Pat. No. 3,292,611 to Belkin discloses an infant mattress with heating and tickling mechanisms for pacifying or distracting an infant reposed thereon. A clock or ticking mechanism and a heating unit are placed within the mattress such that they are located right beneath the infant as reposed on the mattress. The clock comprises a winding knob extending outwards from the mattress for operating or for the setting up of the clock. The clock and the heating unit, both aid in inducing the infant to fall asleep. The present invention has no heating unit, as used in the mattress of Belkin.

U.S. Pat. No. 5,063,912 to Hughes discloses a baby sleep inducer, which can be concealed in a baby crib, mattress, etc. The sleep inducer comprises a battery operated sound reproducing mechanism that is to be received within a foam cover, which in turn is received within an outer covering. The sound reproducing mechanism produces a sound that is characteristic of a womb sound in the last four months of fetus gestation period. This sound has a soothing, calming, and a sleep inducing effect on a baby.

U.S. Pat. No. 5,357,642 to Clute discloses an infant support pillow. The support pillow comprises two similar elongated triangular foam members connected by a flat rectangular panel so as to form a central U-shaped channel. The U-shaped channel is sized and structured for securely supporting an infant on its side while sleeping. The support pillow further comprises an audio emitter placed within a triangular foam member centrally. The audio emitter is structured for emitting a generated sound preferably similar to those sounds experienced by the infant when in the womb so as to promote sleep. However, the present invention differs from the above references as it comprises a sound/vibration generating instrument, which is to be received within a pillow designed to tuck into a variety of positions and locations.

Therefore, it is an object of the present invention to provide a structurally simple infant lulling device.

A further object is to provide an infant lulling device which capable of emitting sound, vibrations, or both so as have a soothing and lulling effect on an infant.

Finally, it is an object of the present invention to provide an infant lulling device comprising a pillow resembling the shape of a butterfly so that the device can be easily tucked into blankets, other pillows, bassinets, cradles, and other child care structures. These and other objects of the present invention will become better understood with reference to the appended Summary, Description, and Claims.

SUMMARY

The present invention is an infant lulling device comprising a pillow and a means for generating sounds and vibrations. The pillow has elongated lobes, giving it the general shape of a butterfly so that the device can be easily tucked into other pillows, blankets, carriers, bassinets, strollers, and cradles. The pillow includes a receptacle within which a sound and vibration generating instrument is received. The instrument can produce either sound or vibrations, or both to provide a soothing atmosphere for an infant as it reposes on or near the pillow. The vibrations emanating from the pillow help infants fall asleep faster and remain asleep for a longer period of time.

FIGURES—REFERENCE NUMERALS

Figure 1:
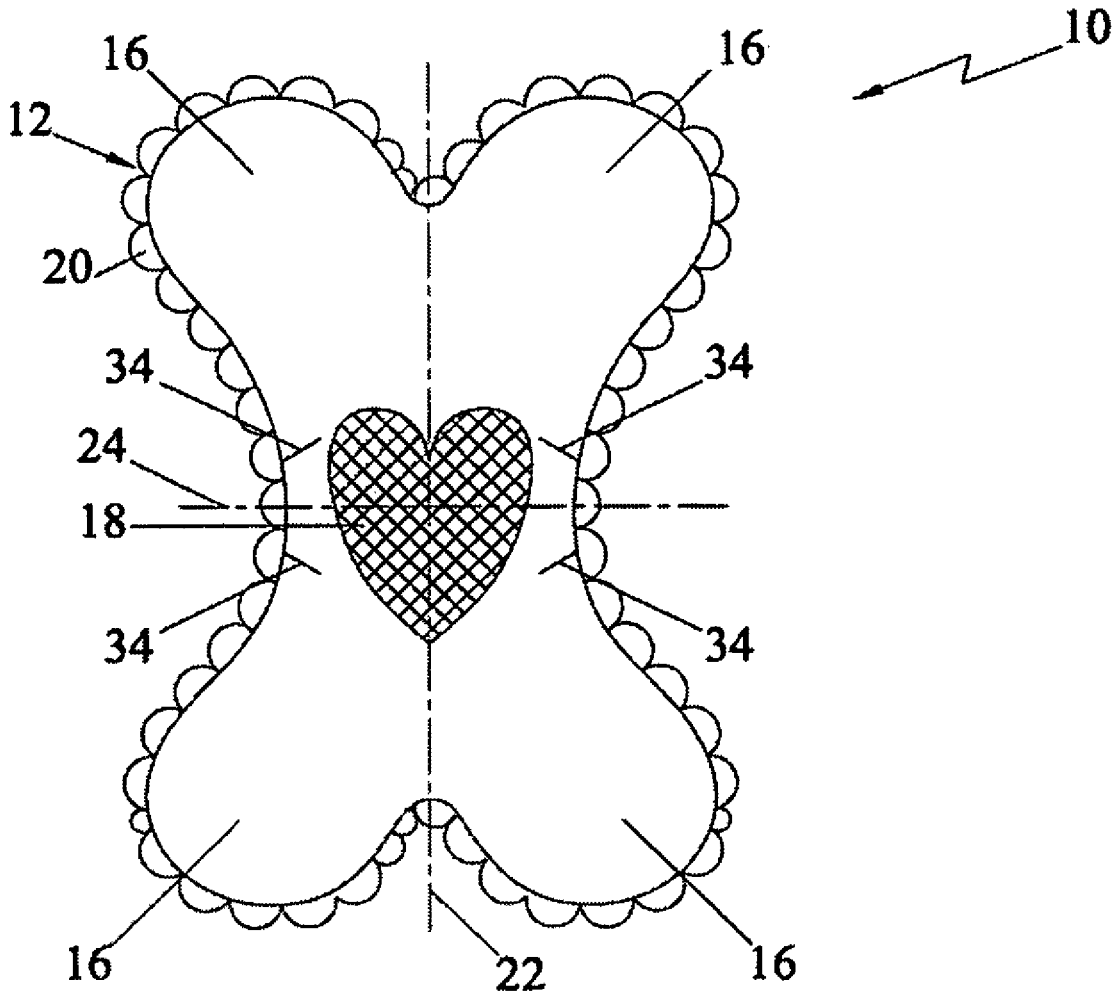
FIG. 1 is a plan view of the front side of the infant lulling device in accordance with the present invention.
Figure 2:
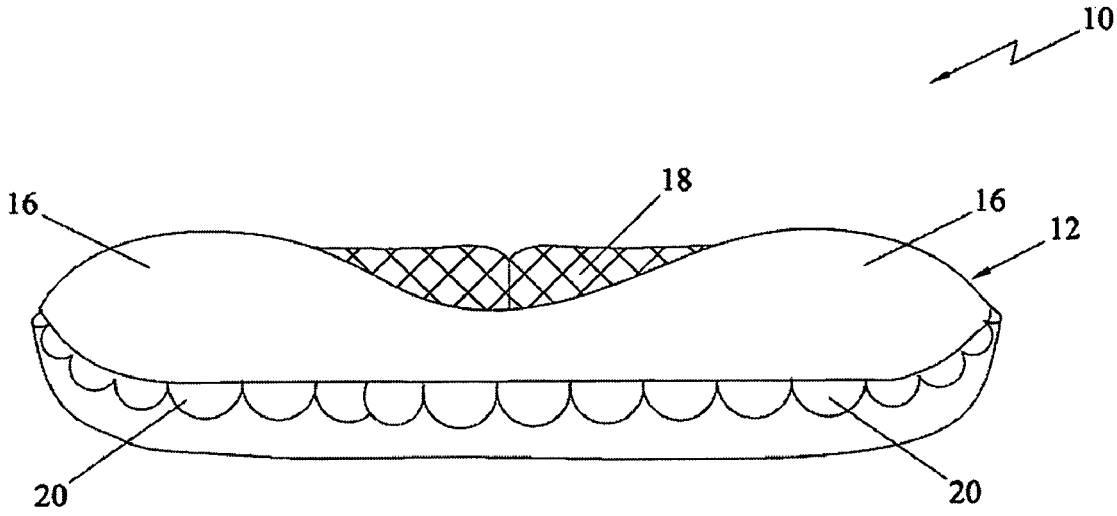
FIG. 2 is a front view of the infant lulling device in accordance with the present invention.
Figure 3:
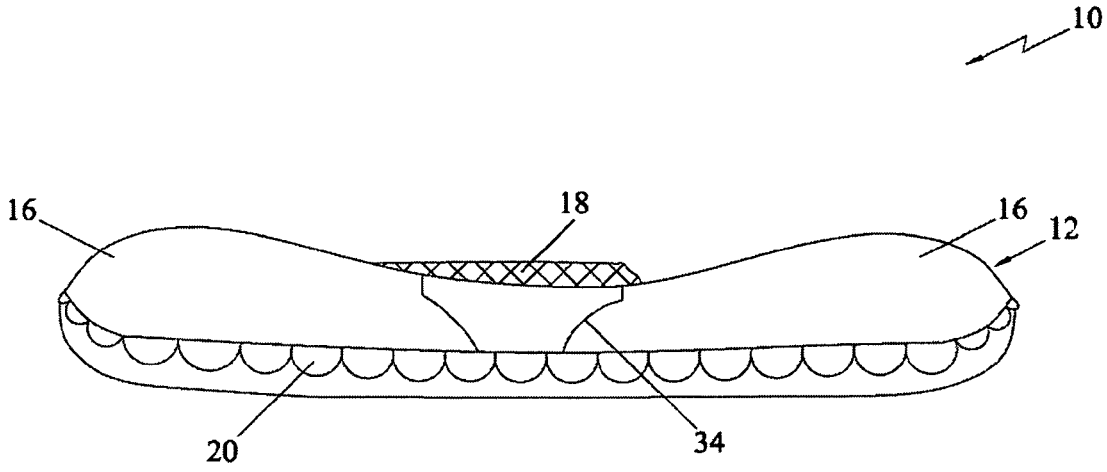
FIG. 3 is a side view of the infant lulling device in accordance with the present invention.

10 . . . Infant Lulling Device
12 . . . Pillow
14 . . . Sound/Vibration Generating Instrument
16 . . . Corner Section
18 . . . Additional Cushion
20 . . . Fabric Ruffles
22 . . . Longitudinal Axis
24 . . . Transverse Axis
26 . . . Receptacle
28 . . . Flap
30 . . . Flap Opening
32 . . . Velcro Strip
34 . . . Velcro Closure Slits

DETAILED DESCRIPTION

Referring to the drawings, a preferred embodiment of an infant lulling device is illustrated and generally indicated as 10 in FIGS. 1 through 5. The device 10 is for lulling an infant to sleep by providing a comforting, soothing and relaxing environment.

Referring to FIGS. 1 through 5, the device 10 comprises a soft plush quilted pillow 12 and a battery-operated sound generating and vibrating instrument 14. In one preferred embodiment, the pillow 12 is made of a polyester and cotton blend fabric. The sides of the pillow are curved inwards, resulting in a number of corner sections 16. The corner sections 16 are rounded and puffed up. In one preferred embodiment, the backside of the pillow 12 is substantially flat, and the corner sections 16 are rounded and puffed up on the front of the device 10.

The device 10 further comprises an additional cushion 18 attached centrally on one side of the pillow 12. In a preferred embodiment, the pillow 12 comprises a butterfly shape, which allows individual lobes 16 to be tucked into tight places, making the device 10 easy to use in conjunction with carriers, bassinets, cradles, baby strollers, etc. The periphery of the pillow 12 comprises ruffles 20. The device 10 further comprises sealable closure slits 34, located between two corner sections 16 along longitudinal axis 22 to create flaps. Straps can be passed through the flaps to fasten the pillow to a bassinet, cradle, or other location. In a preferred embodiment, the pillow 12 is symmetrical about longitudinal 22 and transverse axes 24 passing through the center as seen in FIG. 1.

Figure 4:
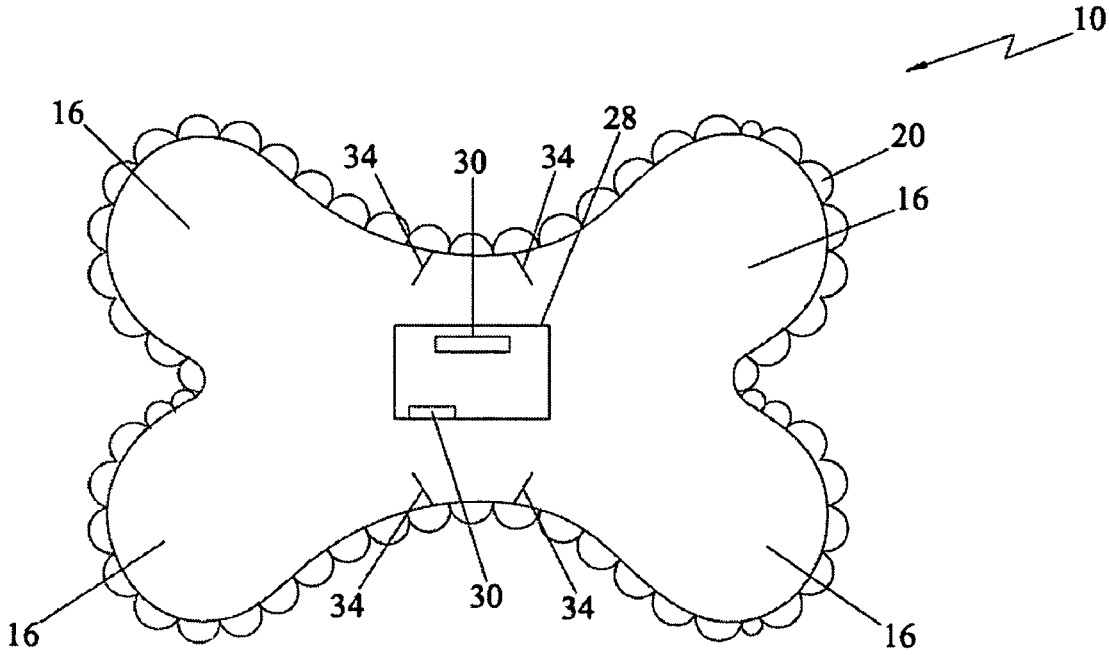
FIG. 4 is a plan view of the backside of the infant lulling device in accordance with the present invention.
Figure 5:
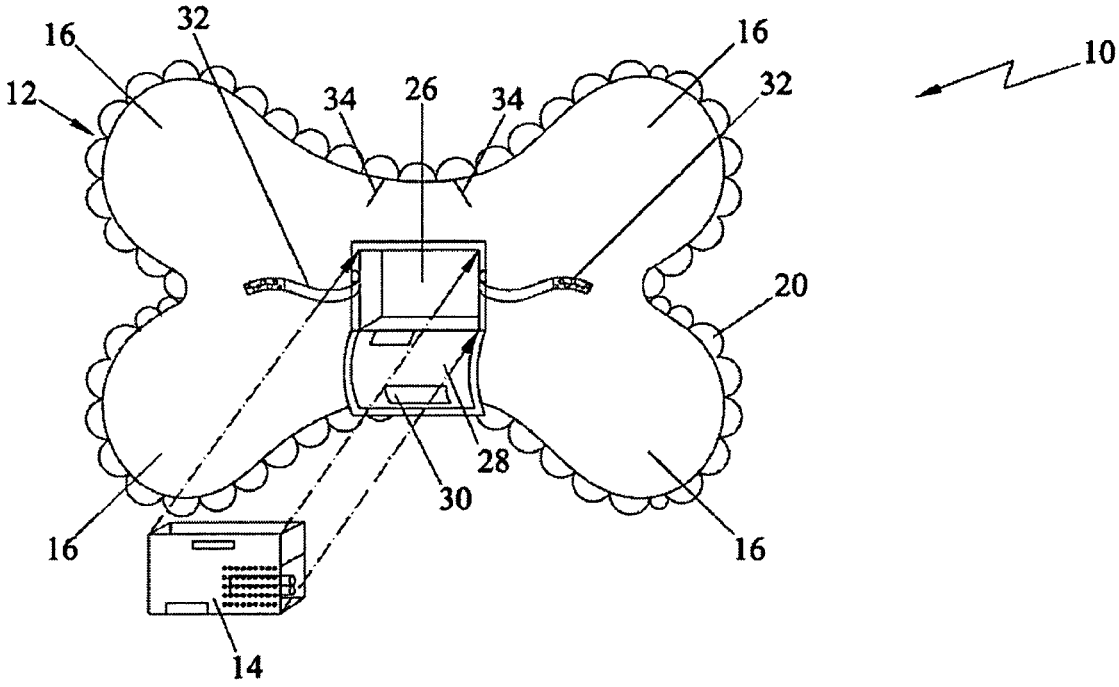
FIG. 5 is a plan view of the backside of the infant lulling device in accordance with the present invention.

Referring to FIGS. 4 and 5, the device 10 further comprises a receptacle 26 located centrally at the backside of the pillow 12. A flap 28, made of fabric in one embodiment, closes over the opening of the receptacle 26 as the edges of the flap 28 and the opening of the receptacle 26 are equipped with a fastening means. The sound and vibration generating instrument 14 is received in the receptacle 26. The flap 28 also comprises an opening 30 to access the controls of the instrument 14; including volume adjustment, power, and any other controls for affecting the sounds or vibrations of the device. The device 10 further comprises a pair of straps 32 extending from opposite edges of the opening of the receptacle 26. The straps 32 are to be secured over the sound generating instrument 14 so that the instrument 14 is held firmly in place.

The sound and vibration generating instrument 14 can be operated to emit either sound or vibrations, or a combination of both. The sound produced from the instrument 14 can be a lullaby or the simulated sound of heartbeat. The sound and vibrations emitted from the device provide a soothing and a soothing and lulling effect on an infant.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. An infant lulling device, comprising:
a. a soft lobed soft core structure; and
b. a sound generating means disposed within the structure; and
c. one or more sealable flaps for retaining a strap.

2. An infant lulling device, comprising:
a. a soft lobed soft core structure;
b. a sound generating means disposed within the structure;
c. one or more sealable flaps for retaining a strap; and
d. a pair of adjacent flaps on either side of the device for accommodating the straps.

* * * * *